US006176677B1

(12) United States Patent
Chévrefils et al.

(10) Patent No.: US 6,176,677 B1
(45) Date of Patent: Jan. 23, 2001

(54) DEVICE FOR CONTROLLING AIR FLOW IN A TURBINE BLADE

(75) Inventors: André Chévrefils, Chateauguay; Daniel Gheorghe Grigore, Pointe Claire, both of (CA)

(73) Assignee: Pratt & Whitney Canada Corp., Longueil (CA)

( * ) Notice: Under 35 U.S.C. 154(b), the term of this patent shall be extended for 0 days.

(21) Appl. No.: 09/314,292

(22) Filed: May 19, 1999

(51) Int. Cl.[7] ..... F01D 5/18
(52) U.S. Cl. ..... 416/96 R; 415/115
(58) Field of Search ..... 416/95, 96 R, 416/97 R, 96 A; 415/115

(56) References Cited

U.S. PATENT DOCUMENTS

| | | | |
|---|---|---|---|
| 3,706,508 | | 12/1972 | Moskowitz et al. . |
| 3,902,820 | * | 9/1975 | Amos ..... 416/97 |
| 4,242,045 | | 12/1980 | Grondahl et al. . |
| 4,626,169 | | 12/1986 | Hsing et al. . |
| 5,538,394 | | 7/1996 | Inomata et al. . |

FOREIGN PATENT DOCUMENTS

| | | | |
|---|---|---|---|
| 850090 | * | 9/1952 | (DE) . |
| 3131405 | | 2/1983 | (DE) . |
| 3306894 | | 8/1984 | (DE) . |

* cited by examiner

*Primary Examiner*—Edward K. Look
*Assistant Examiner*—Liam McDowell
(74) *Attorney, Agent, or Firm*—Jeffrey W. Astle

(57) ABSTRACT

The present invention relates to gas turbines and more particularly to a device for controlling the flow of cooling air through a flowpath in a turbine blade. The device can be inserted in the inlet opening of the blade flowpath and be retained therein. The device comprises a plug member for adjusting the flow of cooling air through the flowpath. The plug member comprises a retaining portion for retaining the plug member at the inlet opening of the flowpath and a blocking portion inserted within the flowpath for reducing the cross-sectional area of the inlet opening. Such a device is inexpensive and can be easily inserted in the inlet opening of a blade flowpath and retained therein.

12 Claims, 2 Drawing Sheets

DEVICE FOR CONTROLLING AIR FLOW IN A TURBINE BLADE

BACKGROUND OF THE INVENTION (a) Field of the Invention

The present invention relates to gas turbines, and more particularly to a device for controlling the flow of cooling air through a flowpath in a turbine blade.

(b) Description of Prior Art

In a turbine engine, gases are compressed in a compressor section, burned with fuel in a combustion section and expanded in a turbine section to extract work from the hot, pressurized gases. The rotor assembly of the turbine section includes a disk having a plurality of circumferentially disposed, spaced apart blade attachment slots, each of which is provided with a turbine blade having a root radially disposed therein and spaced from the bottom part of the slot, thus leaving a cavity therebetween.

During operation of the engine, the hot gases impart energy to the rotor assembly. However, the material of the blades can tolerate a maximum temperature beyond which its vulnerability to damage increases, leading to a lower service life.

It is known to cool turbine blades by flowing cooling air extracted from the compressor section. The cooling air is flowed to the cavities formed in the rotor disk through a stator assembly supporting the combustion section and the rotor assembly. From each cavity, the cooling air is flowed through one or more flowpaths in the blade internal core from an inlet opening at the root thereof and exiting through openings provided near the trailing edge of the blade.

A problem which arises with such a configuration is that the amount of cooling air flowing through the blades cannot be adjusted for the amount of cooling air required.

Devices for adjusting the flow of cooling air into turbine blades are known. For example, U.S. Pat. No. 4,626,169 issued to Hosing et al. describes a perforated rectangular cast seal plate, which is disposed in the cavity between the slot and the blade root, against the bottom surface thereof, and which comprises baffles to accommodate a rivet to retain the blade. The seal plate is provided with a coating applied thereon by a flame spraying method and is installed by tapping it with a hammer in the cavity, the coating providing a tight fit between the seal plate and the disk walls defining the cavity.

A problem with such a device is that the casting of the seal plate needs to correspond to the exact dimensions of the cavity and cooperate with the rivet thereof, which requires expensive machining operations. The openings in the plate can also get clogged.

It would be highly desirable to be provided with an inexpensive device that could be easily inserted in the inlet opening of the blade flowpath and be retained therein.

SUMMARY OF THE INVENTION

One aim of the present invention is to provide an inexpensive device that can be easily inserted in the inlet opening of a blade flowpath and retained therein.

In accordance with the present invention there is provided a device for controlling a flow of cooling air through a flowpath in a turbine blade for cooling the turbine blade. The device comprises a plug member for reducing the flow of cooling air through the flowpath. The plug member comprises a blocking portion adapted to be inserted in the flowpath, and a retaining portion joined to the blocking portion for retaining the plug member at an inlet opening of the flowpath, the retaining portion being adapted to engage against walls of the blade forming the flowpath thereof.

The retaining portion may comprise a first flange and a second flange joined to the first flange with the blocking portion.

The blocking portion may comprise a first intermediate panel, a second intermediate panel and a bight portion joining the first and second intermediate panels, the first and second intermediate panels joining the first and second flanges, respectively.

The plug member may be made of a spring metal material.

In accordance with the present invention there is also provided a turbine blade assembly comprising a turbine blade with a root portion defining an inlet opening, and an inner wall defining a flowpath extending from the inlet opening to an outlet opening, provided at an airfoil surface of the turbine blade, for a flow of cooling air, and a device for controlling the flow of cooling air through the flowpath, the device comprising a blocking portion inserted in the inlet opening, and a retaining portion urging against the root portion defining the inlet opening.

In accordance with the present invention, there is further provided a method for adjusting a flow of cooling air through a flowpath in a turbine blade for cooling the turbine blade. The method comprises a) providing a plug member comprising a blocking portion and a retaining portion, and b) inserting the blocking portion in an inlet opening of the flowpath.

In accordance with the present invention, there is further provided a method for adjusting a flow of cooling air through a flowpath having a cross-sectional area in a turbine blade for cooling the turbine blade. The method comprises a) determining a flow of cooling air required through the flowpath, b) cutting a plug member comprising a blocking portion and a retaining portion to a width to reduce the cross-sectional area of the flowpath to the required flow of cooling air, and c) inserting the blocking portion in an inlet opening of the flowpath.

BRIEF DESCRIPTION OF THE DRAWINGS

Having thus generally described the nature of the invention, reference will now be made to the accompanying drawings, showing by way of illustration a preferred embodiment thereof, in which like numerals refer to like components, and in which.

DETAILED DESCRIPTION OF THE INVENTION

Figure 1:
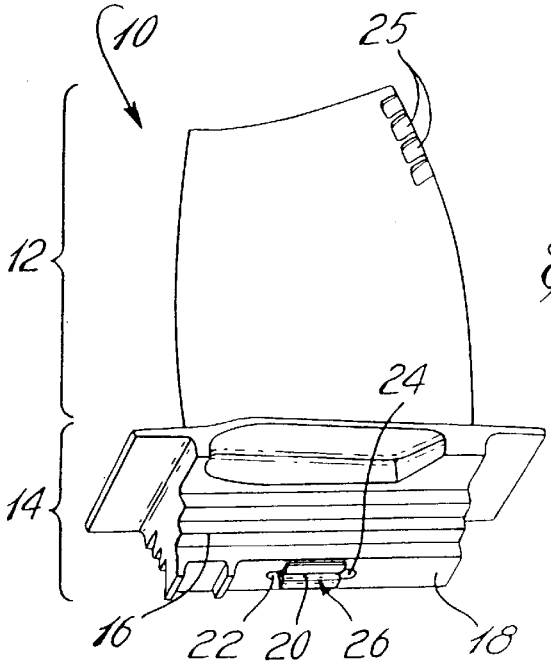
FIG. 1 is a perspective view illustrating an embodiment of a plug in accordance with the present invention in operative position in the blade.

As may be seen in FIG. 1, there is shown a turbine blade 10 having an airfoil section 12 and a root section 14 opposite the airfoil section 12. The root section 14 includes a fir tree shaped attachment section 16 ended by a root bottom surface 18. The root bottom surface 18 is provided with an inlet opening 20 at the center thereof. An inner wall 22 of the turbine blade 10 defines a flowpath 24, which extends from the inlet opening 20 through the turbine blade 10 to outlets 25 provided at the surface of the tip and/or the side trailing edge of the airfoil section. The turbine blade 10 is shown with an embodiment of a device for controlling a flow of cooling air in a turbine blade, herein shown in the form of a plug 26, inserted in the inlet opening 20 of the flowpath 24 to reduce the cross-sectional area of the inlet opening 20.

Figure 2:
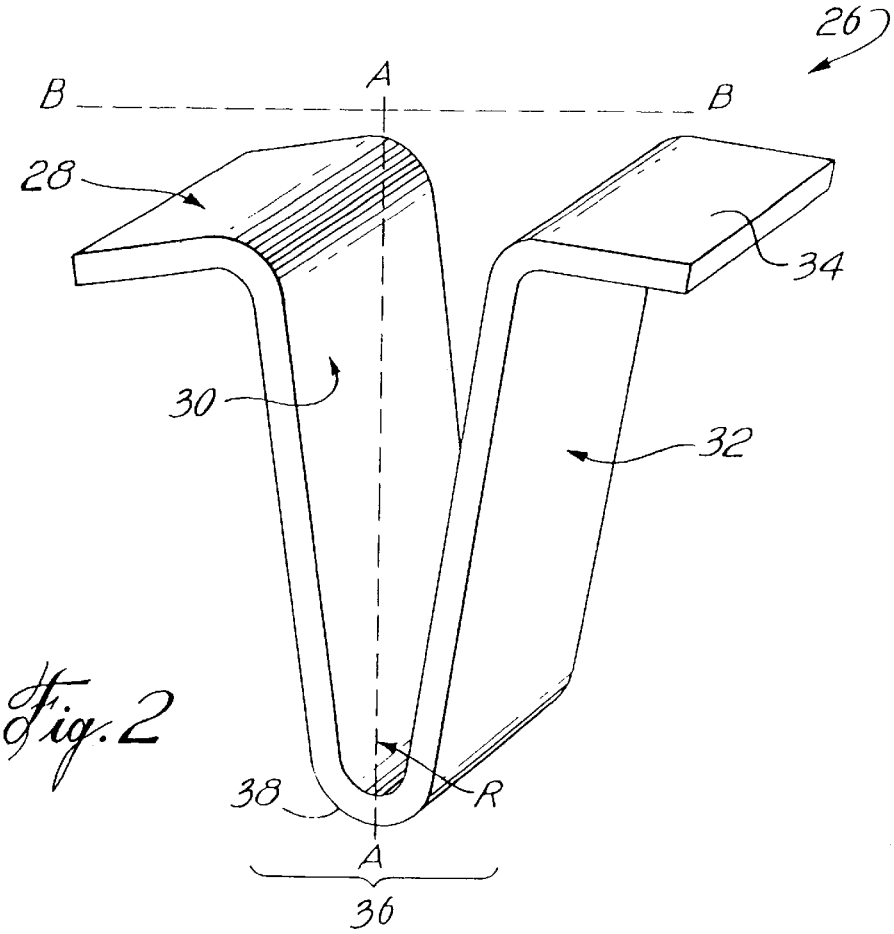
FIG. 2 is a perspective view of the plug shown in FIG. 1.

Referring now to FIG. 2, the plug 26 is made of a strip of a resilient material such as a spring metal, which is symmetrically formed relative to a plane through axis A bisecting the strip V-shape, and which is bent into a first flange 28, first and second elongated intermediate panels 30 and 32 and a second flange 34. The strip of the present embodiment has a thickness of 0.008–0.011 inches. The first and second intermediate panels 30 and 32, disposed adjacent one another and at the center of the sheet, define a blocking portion 36.

The blocking portion 36 includes a bight portion 38, which connects the first and second intermediate panels 30 and 32. The bight portion 38 has a diameter 2R, in the present embodiment 0.045 inches, which corresponds essentially to the width of the flowpath 24 of the turbine blade 10, in which the plug 26 is to be inserted, as will be described hereinafter.

The first and second intermediate panels 30 and 32 are substantially planar and slightly outwardly-flared relative to the plane, such that the distance between the ends thereof opposite the bight portion 38 corresponds to twice the diameter 2R of the bight portion 38. The distance between the ends of the intermediate panels 30 and 32 opposite the bight portion 38 is 0.09 inches in the present embodiment. The height of the blocking portion 36, measured from the bight portion 38 to the ends of the intermediate panels 30 and 32, is 0.2 inches. However, the height of the blocking portion 36 can vary.

The first and second intermediate panels 30 and 32 are respectively curved into the first and second flanges 28 and 34, each of which is outwardly-directed relative to the axis A and disposed at a right angle relative to the intermediate panels 30 and 32. In this manner, the flanges 28 and 34 are slightly acutely angled relative to a second plane through an axis B normal to the axis A when the plug 26 is in an inoperative position, as shown in FIG. 2. The flanges 28 and 34 act as a retainer for the plug 26. Each flange 28 and 34 has a 0.07 inch length in the present embodiment. However, the length of the flanges 28 and 34 can vary.

In operation, the first and second flanges 28 and 34 are adapted to urge against the root bottom surface 18 of the turbine blade 10 on either side of the inlet opening 20 of the flowpath 24 and to retain the plug 26 in place.

Figure 3:
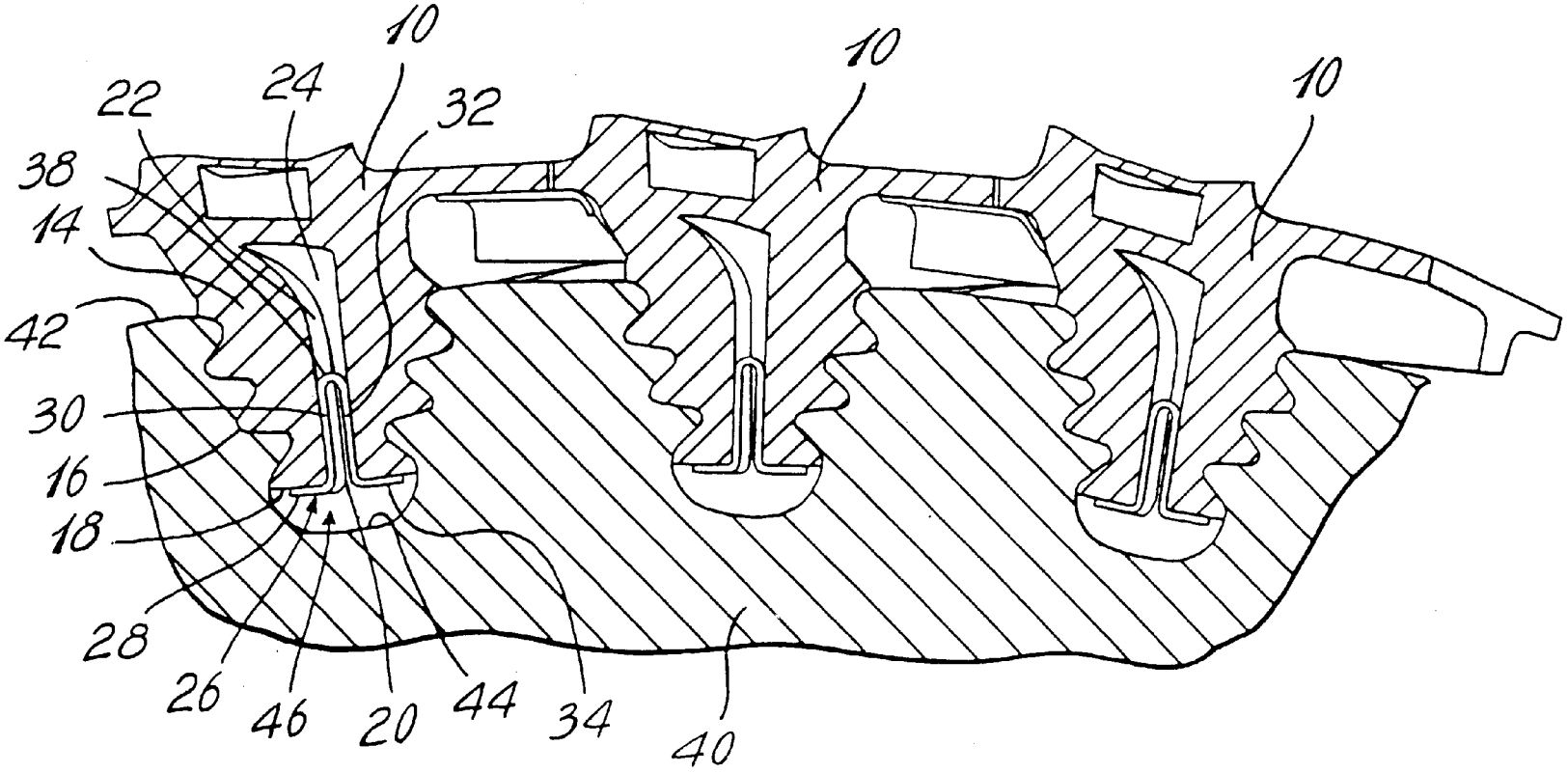
FIG. 3 is a fragmentary radial cross-sectional view of a portion of a rotor assembly according to the embodiment illustrated in FIG. 1.

Referring now to FIG. 3, the rotor assembly includes a rotor disk 40, which is mounted on an engine shaft and is rotatable relative to the shaft axial axis (not shown). The rotor disk 40 has an outer rim 42 having a plurality of circumferentially disposed, spaced apart, axially extending slots 44 corresponding to the fir tree shaped attachment section 16 of the turbine blade 10. The blade attachment section 16, when in a corresponding blade attachment slot 44, leaves a cavity 46 between the outer rim 42 and the root bottom surface 18.

In operation, the plug 26 is mounted to the turbine blade 10 by inserting the bight portion 38 through the inlet opening 20 provided at the root surface 18 of the turbine blade 10 and into the flowpath 24, until the flanges 28 and 34 about against the root bottom surface 18 of the turbine blade 10. During the insertion of the plug 26 into the flowpath 24, the first and second intermediate panels 30 and 32 are biased against the inner wall 22 defining the flowpath 24.

The plug 26 is maintained in position by the friction of the intermediate panels 30 and 32 with the inner wall 22. When the rotor assembly is in motion, the rotation of the rotor disk 40 creates a centrifugal force which maintains the flanges 28 and 34 against the root surface 18 of the turbine blade 10.

Sealing of the flowpath 24 is provided by the shape of the plug 26 and by the CF load.

The plug 26 is tailored to reduce the cross-sectional area of the flowpath 24 to allow a required airflow to circulate. The width of the strip is cut to a width that reduces the cross-sectional area of the flowpath 24 to the required flow of cooling air, allowing an effective airflow between the inner wall 22 of the turbine blade 10 and one or both sides of the plug 26, when the plug 26 is in an operative position in the turbine blade 10.

In one example, a flow of cooling air was reduced from 0.66% to 0.4% of the engine core flow.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

What is claimed is:

1. A device for controlling a flow of cooling air through a flowpath in a turbine blade for cooling said turbine blade, said device comprising a plug member removably insertable into an inlet opening of the flowpath for adjusting said flow of cooling air through said flowpath, said plug member comprising:

a) a resilient blocking portion adapted to be inserted in the inlet opening of said flowpath against a biasing force thereof; and b) a retaining portion joined to said blocking portion for retaining said plug member at the inlet opening of said flowpath, said retaining portion being adapted to engage against a wall of said turbine blade defining said flowpath.

2. A device according to claim 1, wherein said retaining portion comprises a first flange and a second flange joined to said first flange with said blocking portion.

3. A device according to claim 2, wherein said blocking portion comprises a first intermediate panel, a second intermediate panel and a bight portion joining said first and second intermediate panels, said first and second intermediate panels joining said first and second flanges, respectively.

4. A device according to claim 3, wherein said plug member is made of a spring metal material.

5. A turbine blade assembly comprising a turbine blade with a root portion defining an inlet opening, and an inner wall defining a flowpath extending from said inlet opening to an outlet opening, provided at an airfoil surface of said turbine blade, for a flow of cooling air, and a device for controlling said flow of cooling air through said flowpath, said device comprising a resilient blocking portion inserted in said inlet opening and spring biased against said inner wall, and a retaining portion urging against said root portion outwardly of said flowpath.

6. A method for adjusting a flow of cooling air through a flowpath in a turbine blade for cooling said turbine blade, said method comprising:

a) providing a plug member comprising a resilient blocking portion and a retaining portion; and b) inserting said blocking portion against a biasing force thereof in an inlet opening of said flowpath.

7. A method for adjusting a flow of cooling air through a flowpath having a cross-sectional area in a turbine blade for cooling said turbine blade, said method comprising:

a) determining a flow of cooling air required through said flowpath;

b) cutting a plug member comprising a blocking portion and a retaining portion to a width to reduce said cross-sectional area of said flowpath to said required flow of cooling air; and c) inserting said blocking portion in an inlet opening of said flowpath.

8. A device according to claim 1, wherein said plug member has a V-shaped spring-loaded structure.

9. A device according to claim 8, wherein said retaining portion includes first and second flanges respectively extending laterally outwardly from opposite end portions of said V-shaped spring-loaded structure.

10. A turbine blade assembly according to claim 5, wherein said device is provided in the form of a generally V-shaped plug member having a pair of interconnected panels.

11. A turbine blade assembly according to claim 10, wherein said retaining portion includes a pair of flanges extending laterally outwardly from respective distal end portions of said panels.

12. A turbine blade assembly according to claim 11, wherein said plug member is made from a strip of spring material.

* * * * *